US011224955B2

(12) United States Patent
Harada et al.

(10) Patent No.: US 11,224,955 B2
(45) Date of Patent: Jan. 18, 2022

(54) SUBSTRATE PROCESSING APPARATUS AND CONTROL METHOD

(71) Applicant: EBARA CORPORATION, Tokyo (JP)

(72) Inventors: Minoru Harada, Tokyo (JP); Takahiro Nanjo, Tokyo (JP); Hiroyuki Takenaka, Tokyo (JP); Naoki Matsuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 513 days.

(21) Appl. No.: 16/245,989

(22) Filed: Jan. 11, 2019

(65) Prior Publication Data

US 2019/0217438 A1 Jul. 18, 2019

(30) Foreign Application Priority Data

Jan. 11, 2018 (JP) ..... JP2018-002272

(51) Int. Cl.

| | |
|---|---|
| ***B24B 21/00*** | (2006.01) |
| ***B24B 21/20*** | (2006.01) |
| ***B24B 49/16*** | (2006.01) |
| ***B24B 9/06*** | (2006.01) |
| ***B24B 49/00*** | (2012.01) |

(52) U.S. Cl.

CPC ..... *B24B 21/004* (2013.01); *B24B 9/065* (2013.01); *B24B 21/002* (2013.01); *B24B 21/20* (2013.01); *B24B 49/006* (2013.01); *B24B 49/16* (2013.01)

(58) Field of Classification Search

CPC ..... B24B 21/002; B24B 21/004; B24B 21/20; B24B 49/006; B24B 49/16

USPC ..... 451/4, 5, 10, 11, 59, 297, 311

See application file for complete search history.

(56) References Cited

U.S. PATENT DOCUMENTS 2,201,210 A * 5/1940 Brown ..... B21B 37/54 72/11.4
7,066,787 B2 * 6/2006 Nakanishi ..... B24B 9/065 451/297

(Continued)

FOREIGN PATENT DOCUMENTS

JP H09-102152 A 4/1997
JP H09-323851 A 12/1997

(Continued)

OTHER PUBLICATIONS

European Patent Application No. 19151417.3; Extended Search Report; dated May 7, 2019; 6 pages.

*Primary Examiner* — Eileen P Morgan
(74) *Attorney, Agent, or Firm* — BakerHostetler

(57) ABSTRACT

A substrate processing apparatus which causes a processing tape to abut against a processing object, including: a tape supply reel configured to supply the processing tape; a tape recovery reel configured to recover the processing tape; a recovery motor configured to apply a torque to the tape recovery reel; a tape feed motor configured to feed the processing tape between the tape supply reel and the tape recovery reel; and a control unit configured to control the tape feed motor, wherein the control unit controls the torque of the recovery motor depending on a change in an outer diameter of a roll of the processing tape wound by the tape recovery reel such that tension applied to the processing tape is constant, using a feed length of the tape fed by the tape feed motor and a thickness of the processing tape.

9 Claims, 12 Drawing Sheets

(56) References Cited

U.S. PATENT DOCUMENTS

| | | | | |
|---|---|---|---|---|
| 7,976,361 | B2 * | 7/2011 | Takahashi | H01L 21/68792 451/44 |
| 8,029,333 | B2 * | 10/2011 | Takahashi | B24B 9/065 451/8 |
| 8,047,896 | B2 * | 11/2011 | Takahashi | B24B 21/04 451/6 |
| 2003/0066604 | A1 | 4/2003 | Franklin et al. | |
| 2008/0188167 | A1 * | 8/2008 | Ishii | B24B 9/065 451/307 |
| 2009/0093192 | A1 * | 4/2009 | Takahashi | B24B 9/065 451/6 |
| 2009/0325465 | A1 * | 12/2009 | Takahashi | B24B 21/004 451/6 |

FOREIGN PATENT DOCUMENTS

| | | | |
|---|---|---|---|
| JP | H10-035969 | A | 2/1998 |
| JP | 2002-114420 | A | 4/2002 |
| JP | 2004-223658 | A | 8/2004 |
| JP | 2006-303112 | A | 11/2006 |
| JP | 2007-066458 | A | 3/2007 |
| JP | 2008-087136 | A | 4/2008 |
| JP | 2008-177391 | A | 7/2008 |

* cited by examiner

SUBSTRATE PROCESSING APPARATUS AND CONTROL METHOD

CROSS-REFERENCE TO RELATED APPLICATIONS

This application claims the benefit of Japanese Priority Patent Application JP 2018-002272 filed on Jan. 11, 2018, the entire contents of which are incorporated herein by reference.

FIELD

The present technique relates to a substrate processing apparatus and a control method.

BACKGROUND AND SUMMARY

In a substrate processing apparatus in the related art, a torque of a motor which rotates a tape supply reel (also referred to as a tape supply roller) supplying a processing tape (for example, polishing tape) which is a tape for processing a substrate is controlled such that tension of the tape is constant. For example, in JP 2006-303112 A, it is disclosed that a tape outer diameter detected by a tape outer diameter detection means is sent to a controller of a motor which feeds a tape from a tape supply roller, and thus, a torque value of the motor which feeds the tape from the tape supply roller is smoothly switched continuously, and tension of the tape is constant. Here, the tape outer diameter detection means disclosed in JP 2006-303112 A includes an optical sensor having a light projecting unit and a light receiving unit, and the outer diameter of the tape wound around the tape supply roller is detected by detecting an amount of light received by the light receiving unit.

In addition, in JP 2008-87136 A, it is disclosed that an outer diameter of a roll of a polishing tape is calculated, output torque of a drive motor rotating a tape supply reel and output torque of a drive motor rotating a tape recovery reel are calculated such that tension applied to the polishing tape in a subsequent processing is a predetermined constant value, and both drive motors are controlled such that the output torque is realized. Here, a calculation of the outer diameter of the roll of the polishing tape is performed by changing a tilt angle of a polishing head from 0° to $\alpha$°, detecting a rotation angle of the tape recovery reel by a rotary encoder, and returning the tilt angle to a standby angle.

However, in the tape outer diameter detection means disclosed in JP 2006-303112 A, it is necessary to provide the optical sensor having the light projecting unit and the light receiving unit, and thus, there are problems that space for installing the light projecting unit and the light receiving unit is required on both sides of the tape supply reel and a cost increases. Moreover, in JP 2008-87136 A, in order to calculate the outer diameter of the tape, it is necessary to tilt the polishing head and detect the rotation angle of the tape recovery reel by the rotary encoder, and thus, there are problems that it is not possible to correctly calculate the outer diameter of the tape during polishing and processing is required between polishing processing.

SUMMARY

The present technique is made in consideration of the above-described problems, and it is preferable to provide a substrate processing apparatus and a control method capable of reducing a cost and constantly maintaining tension applied to the processing tape without requiring additional processing between target processing.

A substrate processing apparatus according to one embodiment, the substrate processing apparatus which causes a processing tape to abut against a processing object and processes the processing object by a relative movement of the processing tape and the processing object, comprising: a tape supply reel configured to supply the processing tape; a tape recovery reel configured to recover the processing tape; a recovery motor configured to apply a torque to the tape recovery reel; a tape feed motor configured to feed the processing tape between the tape supply reel and the tape recovery reel; and a control unit configured to control the tape feed motor, wherein the control unit controls the torque of the recovery motor depending on a change in an outer diameter of a roll of the processing tape wound by the tape recovery reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A substrate processing apparatus according to another embodiment, the substrate processing apparatus which causes a processing tape to abut against a processing object and processes the processing object by a relative movement of the processing tape and the processing object, comprising: a tape supply reel configured to supply the processing tape; a supply motor configured to apply a torque to the tape supply reel; a tape recovery reel configured to recover the processing tape; a tape feed motor configured to feed the processing tape between the tape supply reel and the tape recovery reel; and a control unit configured to control the tape feed motor, wherein the control unit controls the torque of the supply motor depending on a change in an outer diameter of a roll of the processing tape in the tape supply reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A control method according to one embodiment, the control method performed by a substrate processing apparatus which includes a tape supply reel configured to supply a processing tape, a tape recovery reel configured to recover the processing tape, a recovery motor configured to apply a torque to the tape recovery reel, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising: controlling, by the control unit, the torque of the recovery motor depending on a change in an outer diameter of a roll of the processing tape wound by the tape recovery reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A control method according to another embodiment, the control method performed by a substrate processing apparatus which includes a tape supply reel configured to supply a processing tape, a supply motor configured to apply a torque to the tape supply reel, a tape recovery reel configured to recover the processing tape, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising: controlling, by the control unit, the torque of the supply motor depending on a change in an outer diameter of a roll of the processing tape in the tape supply reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

DETAILED DESCRIPTION

Figure 1:
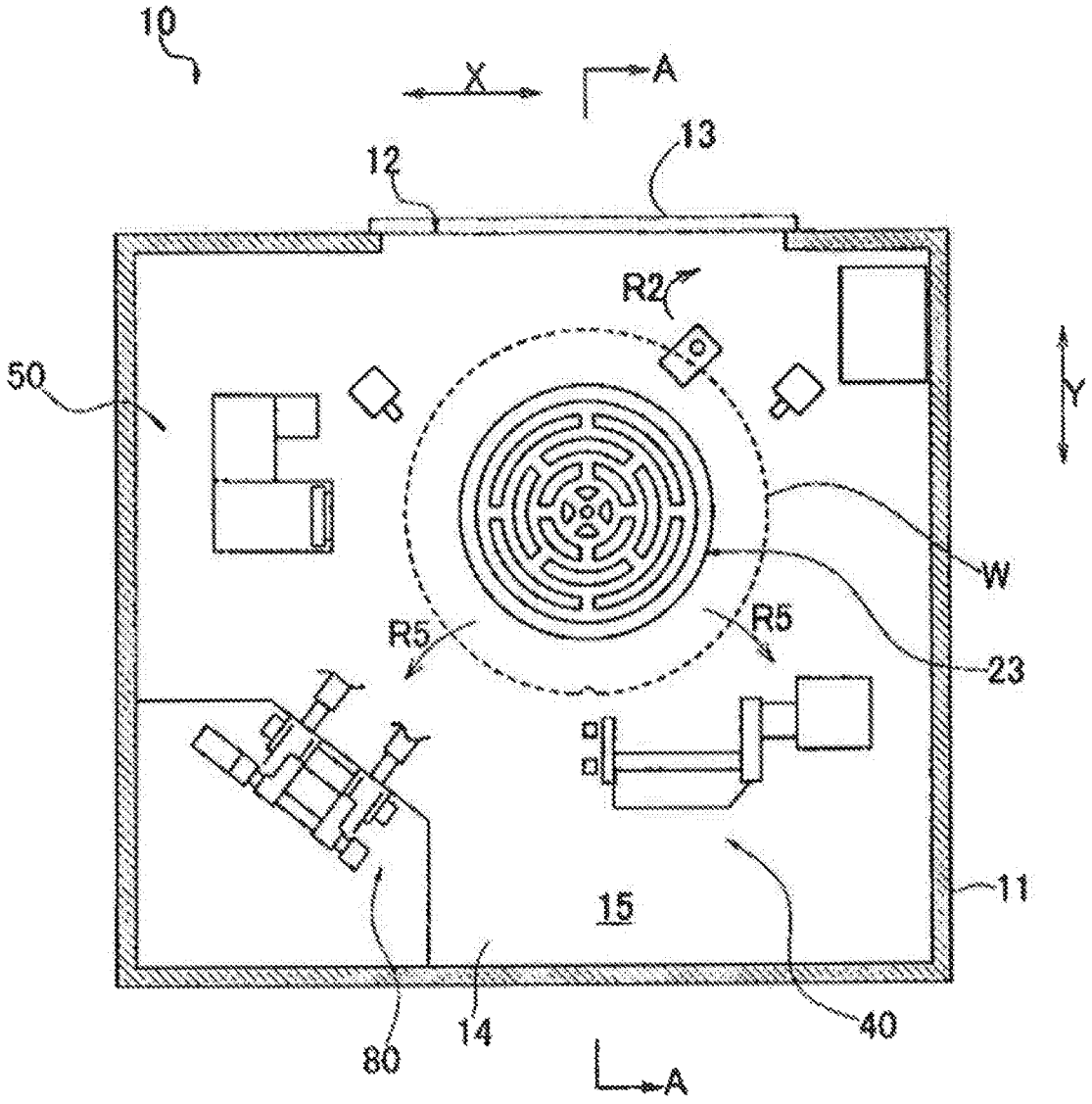
FIG. 1 is a plan sectional view showing a configuration example of a substrate processing apparatus using a polishing apparatus according to the present embodiment.

Hereinafter, each embodiment will be described with reference to the drawings. However, descriptions with more detail than necessary may be omitted. For example, detailed descriptions of already well-known matters or overlapping descriptions with respect to substantially the same configurations may be omitted. This is to avoid the unnecessary redundancy of the following description and to facilitate understanding by those skilled in the art. In the present embodiment, an example of target processing is polishing, an example of a processing tape is a polishing tape, and a processing object is a polishing object.

A substrate processing apparatus according to a first aspect of the embodiment, the substrate processing apparatus which causes a processing tape to abut against a processing object and processes the processing object by a relative movement of the processing tape and the processing object, comprising: a tape supply reel configured to supply the processing tape; a tape recovery reel configured to recover the processing tape; a recovery motor configured to apply a torque to the tape recovery reel; a tape feed motor configured to feed the processing tape between the tape supply reel and the tape recovery reel; and a control unit configured to control the tape feed motor, wherein the control unit controls the torque of the recovery motor depending on a change in an outer diameter of a roll of the processing tape wound by the tape recovery reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A substrate processing apparatus according to a second aspect of the embodiment is the substrate processing apparatus according to the first aspect, wherein the control unit determines the outer diameter of the roll of the processing tape recovered by the tape recovery reel based on the feed length of the tape fed by the tape feed motor and the thickness of the processing tape, and controls the torque of the recovery motor depending on the outer diameter of the roll.

According to this configuration, since the torque of the recovery motor is controlled depending on the outer diameter of the roll of the processing tape, it is possible to constantly maintain the tension applied to the processing tape.

A substrate processing apparatus according to a third aspect of the embodiment is the substrate processing apparatus according to the second aspect, wherein the recovery motor is a torque motor, when the outer diameter of the roll of the processing tape is a maximum diameter, a torque command value output from a controller when the processing tape is pulled by setting tension, which is the tension constantly applied to the processing tape, is stored in a storage device as a set torque command value, and the control unit has a controller which outputs the set torque command value, a torque variable module which determines a torque at which the tension of the processing tape is constant depending on the determined diameter or radius of the roll of the processing tape, determines a coefficient obtained by dividing the determined torque by the set torque command value, multiplies the torque command value by the coefficient, and outputs the torque command value after the multiplication, and a driver which drives the recovery motor such that a torque of the torque command value output from the torque variable module is applied to the recovery motor.

According to this configuration, in a case where the recovery motor is a torque motor, it is possible to constantly maintain the tension applied to the processing tape. Since the torque motor is cheaper than a servo motor, a cost can be reduced.

A substrate processing apparatus according to a fourth aspect of the embodiment is the substrate processing apparatus according to the third aspect, wherein the torque variable module has a D/A converter, and the D/A converter converts the torque command value from a digital signal into an analog signal when the torque command value is output, and outputs the converted signal.

According to this configuration, it is possible to output the torque command value to the driver by the analog signal.

A substrate processing apparatus according to a fifth aspect of the embodiment is the substrate processing apparatus according to any one of the first aspect to the fourth aspect, wherein the tape feed motor is a servo motor, and the control unit determines a feed length of the tape fed by the tape feed motor, based on the number of rotations of the servomotor from a feeding start of the processing tape to a current time and a preset tape feed length per revolution.

According to this configuration, since the tape feed length can be accurately determined, it is possible to accurately determine the outer diameter of the roll of the processing tape wound by the tape recovery reel, and it is possible to constantly maintain the tension applied to the processing tape depending on a change in the outer diameter of the roll of the processing tape.

A substrate processing apparatus according to a sixth aspect of the embodiment is the substrate processing apparatus according to any one of the first aspect to the fifth aspect, wherein the control unit determines a replacement timing of the processing tape using the feed length of the tape fed by the tape feed motor.

According to this configuration, it is possible to replace the processing tape at any timing just before the tape feed length is the same as the length of the roll of the processing tape.

A substrate processing apparatus according to a seventh aspect of the embodiment is the substrate processing apparatus according to any one of the first aspect to the sixth aspect, further comprising a supply motor configured to apply a torque to the tape supply reel, wherein the supply motor is a servo motor, and the control unit controls the torque applied to the supply motor such that tension applied to the processing tape is constant depending on the outer diameter of the processing tape wound around the tape supply reel.

According to this configuration, the tension of the processing tape when the processing tape is discharged from the tape supply reel can be constantly maintained.

A substrate processing apparatus according to an eighth aspect of the embodiment, the substrate processing apparatus which causes a processing tape to abut against a processing object and processes the processing object by a relative movement of the processing tape and the processing object, comprising: a tape supply reel configured to supply the processing tape; a supply motor configured to apply a torque to the tape supply reel; a tape recovery reel configured to recover the processing tape; a tape feed motor configured to feed the processing tape between the tape supply reel and the tape recovery reel; and a control unit configured to control the tape feed motor, wherein the control unit controls the torque of the supply motor depending on a change in an outer diameter of a roll of the processing tape in the tape supply reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A control method according to a ninth aspect of the embodiment, the control method performed by a substrate processing apparatus which includes a tape supply reel configured to supply a processing tape, a tape recovery reel configured to recover the processing tape, a recovery motor configured to apply a torque to the tape recovery reel, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising: controlling, by the control unit, the torque of the recovery motor depending on a change in an outer diameter of a roll of the processing tape wound by the tape recovery reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

A control method according to a tenth aspect of the embodiment, the control method performed by a substrate processing apparatus which includes a tape supply reel configured to supply a processing tape, a supply motor configured to apply a torque to the tape supply reel, a tape recovery reel configured to recover the processing tape, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising: controlling, by the control unit, the torque of the supply motor depending on a change in an outer diameter of a roll of the processing tape in the tape supply reel such that tension applied to the processing tape is constant, using a feed length of the tape fed by the tape feed motor and a thickness of the processing tape.

According to this configuration, the control unit can constantly maintain the tension applied to the processing tape using a feeding amount of the processing tape fed by a tape feed motor controlled by the control unit and a known thickness of the processing tape. Therefore, it is not necessary to install an optical sensor, and it is possible to reduce a cost. In addition, since the feeding amount of the processing tape fed by the tape feed motor is determined by the control by the control unit, it is possible to grasp the feeding amount of the processing tape even during processing, and additional processing is not required between target processing and a subsequent target processing. In this way, it is possible to constantly maintain the tension applied to the tape while reducing the cost and without requiring the additional processing between the target processing and the subsequent target processing.

Figure 2:
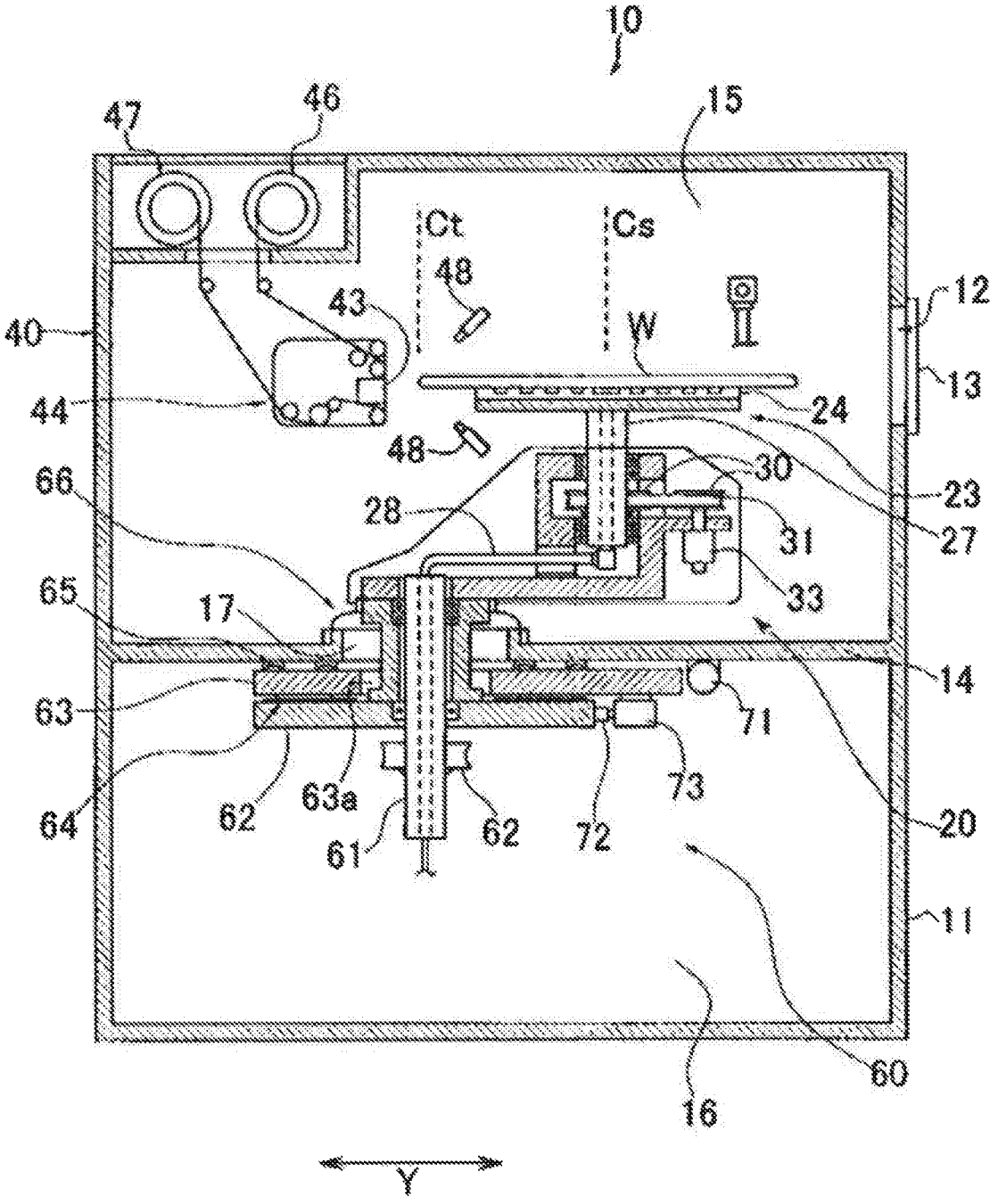
FIG. 2 is a sectional view taken along line A-A of FIG. 1.

FIG. 1 is a plan sectional view showing a configuration example of a substrate processing apparatus using a polishing apparatus according to the present embodiment. FIG. 2 is a sectional view taken along line A-A of FIG. 1. A substrate processing apparatus 10 includes a substrate holding stage unit 20 having a substrate holding stage 23 for holding a substrate, a substrate holding stage movement means 60 for moving the substrate holding stage unit 20 in a direction parallel to a surface of the substrate holding stage 23, and two or more polishing sections for polishing a peripheral edge of a substrate W held by the substrate holding stage 23. In addition, in the present embodiment, for example, a semiconductor wafer is used as the substrate W. However, the substrate W is not limited to the semiconductor wafer.

Here, in a shown in example, the substrate processing apparatus is described, which has two polishing sections of a notch polishing section 40 for polishing a notch of the substrate W held by the substrate holding stage 23 and a bevel polishing section 50 for polishing a bevel part (peripheral edge part) of the substrate W held by the substrate holding stage 23, as the two or more polishing sections. As the two or more polishing sections, more notch polishing sections or bevel polishing sections may be provided. That is, for example, in each of the notch polishing section and the bevel polishing section, rough polishing can be performed in a first polishing section, finish polishing can be performed in a second polishing section, and cleaning can be performed in a third polishing section.

A housing 11 is divided into two spaces by a partition plate 14, an upper space is an upper chamber 15, and a lower space is a lower chamber 16. The substrate holding stage unit 20 and the notch polishing section 40 are accommodated and disposed in the upper chamber 15, and the substrate holding stage movement means 60 is accommodated and disposed in the lower chamber 16.

An opening part 12 is provided on a side surface of the upper chamber 15. The opening part 12 is opened and closed by a shutter 13 which is driven by a cylinder (not shown). The substrate W is loaded in and unloaded from the housing 11 through the opening part 12. The loading and unloading of the substrate W is performed by a known substrate conveying means such as a conveying robot hand (described in detail later). In addition, by closing the opening part 12 of the housing 11 using the shutter 13, an inside of the housing 11 is completely blocked from the outside, and a degree of cleanliness and airtightness in the housing 11 are maintained during polishing, and thus, it is possible to prevent contamination of the substrate W from the outside of the housing 11 and contamination of the outside of the housing 11 caused by scattering of a polishing liquid, particles, or the like from the inside of the housing 11 during polishing.

The substrate processing apparatus 10 according to the present embodiment includes a substrate chuck mechanism 80 for placing the substrate W loaded in the housing 11 on the substrate holding stage 23 or picking up the substrate W held by the substrate holding stage 23 from the substrate holding stage 23.

Figure 3:
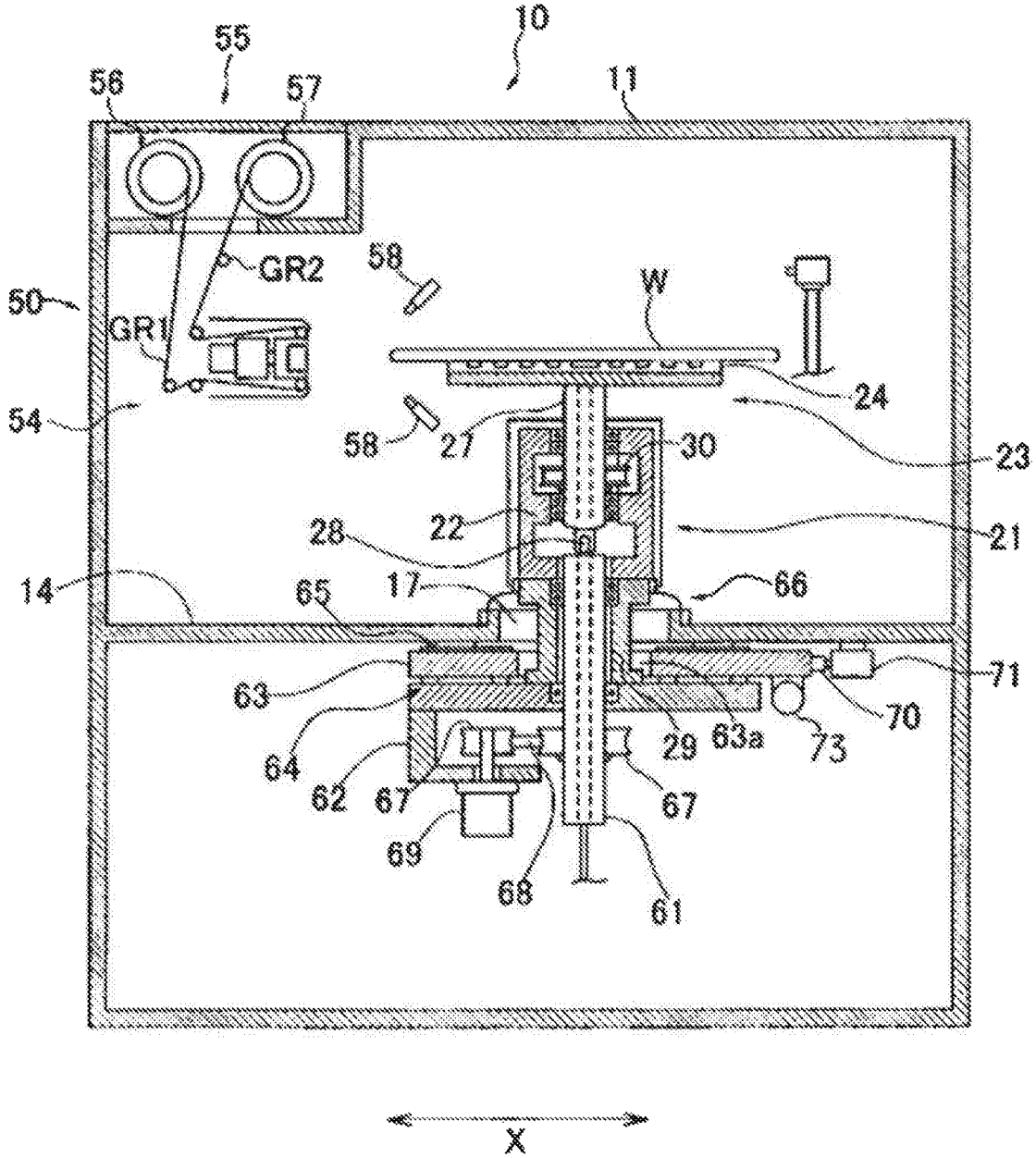
FIG. 3 is a view showing a configuration of a polishing tape supply/recovery mechanism of the polishing apparatus according to the present embodiment.

As shown in FIGS. 1 to 3, the substrate holding stage unit 20 further has a substrate holding stage rotating means for rotating the substrate holding stage 23 and a stage turning reciprocating means for turnably reciprocating (reciprocating the substrate holding stage 23 in a direction of an arrow R5 in FIG. 1) the substrate holding stage 23 in the same plane as a surface of the substrate W held by the substrate holding stage 23 with respect to a notch part of the substrate W held by the substrate holding stage 23.

The substrate holding stage 23 has a flat surface on which one or a plurality of suction holes (not shown) communicating with a vacuum pump (not shown) is provided. A pad 24 having a certain height (thickness) and elasticity is attached to the surface such that the suction holes are not blocked. The substrate W is placed on the pad 24. The suction holes communicate with an external vacuum pump (not shown) through a pipe 28 which is rotatably attached to a lower end of a hollow shaft 27 and a hollow shaft 61.

A groove (not shown) communicating with the suction holes is formed on an upper surface of the pad 24. More preferably, a plurality of concentric annular grooves (not shown) and a plurality of grooves (not shown) connecting the annular grooves (not shown) to each other are formed on the upper surface of the pad 24, and the annular grooves (not shown) and radial grooves 26*b* communicate with the vacuum pump. When the substrate W is placed on the pad 24, the grooves (not shown) are hermetically sealed by a back surface of the substrate W. In addition, if the vacuum pump is driven, the substrate W is sucked, supported on the pad 24, and sucked and held on the substrate holding stage 23 without being deformed (bent).

As shown in FIGS. 2 and 3, the substrate holding stage rotating means includes a shaft 27 which is attached to a rear side of the substrate holding stage 23 coaxially with a rotation axis Cs and a motor 33 which is connected to the shaft 27 via a pulley 30 and a belt 31. The shaft 27 is rotatably attached to a support 22 of a unit main body 21 via a bearing. The motor 33 is fixed to the support 22. If the motor 33 is driven, the substrate holding stage 23 rotates about the shaft 27.

The stage turning reciprocating means turnably reciprocates the substrate holding stage 23 in the same plane as the surface of the substrate holding stage 23. The stage turning reciprocating means includes the shaft 61, which penetrates an opening part 17 of the partition plate 14 of the housing 11 and is fixed to a lower surface of the support 22 of the unit main body 21 of the substrate holding stage unit 20, at a position offset by a length of an approximate radius of the substrate W from the rotation axis Cs of the substrate holding stage 23, and a motor 69 which is connected to the shaft 61 via a pulley 67 and a belt 68 below the partition plate 14. The shaft 61 is rotatably attached to a hollow cylindrical shaft base 29 via a bearing. A lower surface of the shaft base 29 is fixed to a support plate 62 which is positioned below the partition plate 14 of the housing 11 and an upper surface of the shaft base 29 abuts against a lower surface of the unit main body 21 so as to support the unit main body 21.

Moreover, the motor 69 is fixed to the support plate 62. If the motor 69 is driven, the substrate holding stage unit 20 is turnably reciprocated (reciprocated in the direction shown by the arrow R5 in FIG. 1) in the same plane as the surface of the substrate holding stage 23 at the offset position, that is, with respect to a turning axis Ct. More preferably, the stage turning reciprocating means turnably reciprocates the substrate holding stage 23 holding the substrate W in the same plane as the surface of the substrate holding stage 23 with respect to a notch of the substrate W.

As shown in FIGS. 2 and 3, the substrate holding stage movement means 60 includes the support plate 62 for fixing the shaft base 29 of the stage turning reciprocating means and is configured to move the support plate 62 in the direction parallel to the surface of the substrate holding stage 23.

As shown in the drawings, the substrate holding stage movement means 60 has a movable plate 63 which is positioned between the partition plate 14 of the housing 11 and the support plate 62 and is attached to the partition plate 14 via a linear guide 65 to be movable in a first direction (direction of an arrow X shown in FIGS. 1 and 3), and a motor 71 which is fixed to the lower surface of the partition plate 14 for driving a ball screw 70 connected to the movable plate 63 so as to move the movable plate 63 in the arrow X direction. The movable plate 63 has an opening part 63*a* and the shaft base 29 passes through the opening part 63*a*. In addition, the support plate 62 is attached to the lower surface of the movable plate 63 via a linear guide 64 to be movable in a direction (direction shown by an arrow Y in FIGS. 1 and 2) orthogonal to the first direction X, and a ball screw 72 is driven by a motor 73 fixed to the movable plate 63 in order to move the support plate 62 in the arrow Y direction. That is, if the motor 71 is driven, the ball screw 70 connected to the movable plate 63 is rotated, and thus, the movable plate 63 moves in the arrow X direction.

In addition, if the motor 73 fixed to the movable plate 63 is driven, the ball screw 72 connected to the support plate 62 rotates, and thus, the support plate 62 moves in the arrow Y direction with respect to the movable plate 63. In addition, movement ranges of the substrate holding stage unit 20 in the directions of the arrows X and Y are dependent on a size of the opening part 17 provided in the partition plate 14 and a size of the opening part 63*a* provided in the movable plate 63, and thus, in order to increase the movement range of the substrate holding stage unit 20, the sizes of the opening parts 17 and 63*a* may be increased in a design step of the substrate processing apparatus 10.

Figure 4:
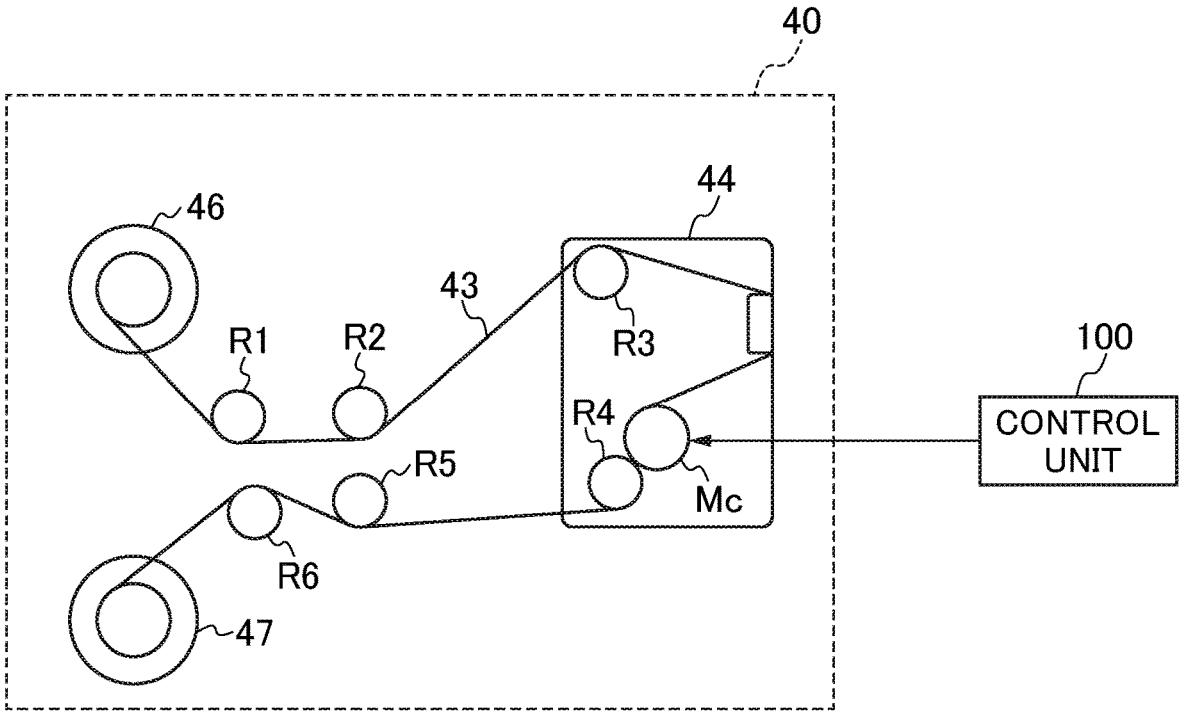
FIG. 4 is a schematic configuration diagram of a notch polishing section according to the present embodiment.

FIG. 4 is a schematic configuration diagram of the notch polishing section 40 according to the present embodiment. In the polishing apparatus according to the present embodiment, the notch polishing section 40 causes the polishing tape to abut against the polishing object (here, for example, a notch part of the substrate W) and polishes the polishing object by a relative movement of the polishing tape and the polishing object. As shown in FIG. 4, the notch polishing section 40 includes a tape supply reel 46 for supplying the polishing tape, a polishing head 44, and a tape recovery reel 47 for recovering the polishing tape. In addition, the notch polishing section 40 includes rollers R1, R2, R5, and R6.

The polishing head 44 includes rollers R3 and R4 and a tape feed motor Mc which feeds a polishing tape 43. The control unit 100 controls the tape feed motor Mc. Here, for example, the tape feed motor Mc according to the present embodiment is a servo motor. In this case, the control unit 100 according to the present embodiment determines a feed length of the tape fed by the tape feed motor Mc, based on the number of rotations of the servo motor from a feeding start of the polishing tape 43 to the current time and a preset tape feed length per revolution. According to this configuration, since the tape feed length can be accurately determined, it is possible to accurately determine an outer diameter of the roll of the polishing tape wound by the tape recovery reel, and it is possible to constantly maintain tension applied to the polishing tape depending on a change in the outer diameter of the roll of the polishing tape.

Moreover, for example, in the present embodiment, the tape feed motor Mc is provided in the polishing head 44. However, the present technique is not limited to this, and the tape feed motor Mc may be disposed at any location as long as it is disposed between the tape supply reel 46 and the tape recovery reel 47.

The notch polishing section 40 has a vertical reciprocating means for reciprocating the polishing head 44 in a direction perpendicular to the surface of the substrate W in a state where the polishing tape 43 is pressed to the notch part of the substrate W. Although the vertical reciprocating means is not shown, the vertical reciprocating means includes a linear guide which is long in the direction perpendicular to the surface of the substrate holding stage 23 and a crank/shaft mechanism for reciprocating the polishing head 44 by driving of a motor.

In addition, the notch polishing section 40 has a polishing head tilt mechanism which turnably reciprocates the polishing head 44 with respect to the notch part in a state where the polishing tape 43 is pressed to the notch part such that a surface side of the notch of the substrate W is polished. Although the polishing head tilt mechanism is not shown, the polishing head tilt mechanism includes a shaft which extends in a direction perpendicular to a traveling direction of the polishing tape 43 and a motor which rotates the shaft. The shaft is disposed at a position at which the notch part of the substrate W is pressed to the polishing tape 43. In addition, the shaft (the shaft becomes a turning shaft of the polishing head 44) is connected to the polishing head 44. If the motor is driven and the shaft is rotated, the polishing tape is turned with the shaft as the turning shaft in a state of being pressed, and thus, it is possible to polish a front surface side and a rear surface of the notch part of the substrate W.

The notch polishing section 40 further has a nozzle 48 which supplies a slurry-like polishing liquid in which abrasive grains are dispersed to a water reaction solution or a water-based reaction solution or cooling water to the notch part of the substrate W.

As shown in FIG. 3, the bevel polishing section 50 includes a polishing head 54 and a polishing tape supply/recovery mechanism 55 (see FIG. 3) which supplies the polishing tape to the polishing head 54 and winds up the supplied polishing tape on a distal end of the bevel polishing section 50.

The polishing tape supply/recovery mechanism 55 includes a tape supply reel 56 around which the polishing tape is wound, a tape recovery reel 57 for winding up the polishing tape from the tape supply reel 56, and a driving means (not shown) which drives the tape recovery reel 57 to wind up the polishing tape. The polishing tape in the polishing head 54 is pressed to the bevel part of the substrate W, and thus, the bevel part is polished.

The bevel polishing section 50 further has a nozzle 58 (nozzle FIG. 3) which supplies a slurry-like polishing liquid in which abrasive grains are dispersed to a water reaction solution or a water-based reaction solution or cooling water to a bevel.

Figure 5:
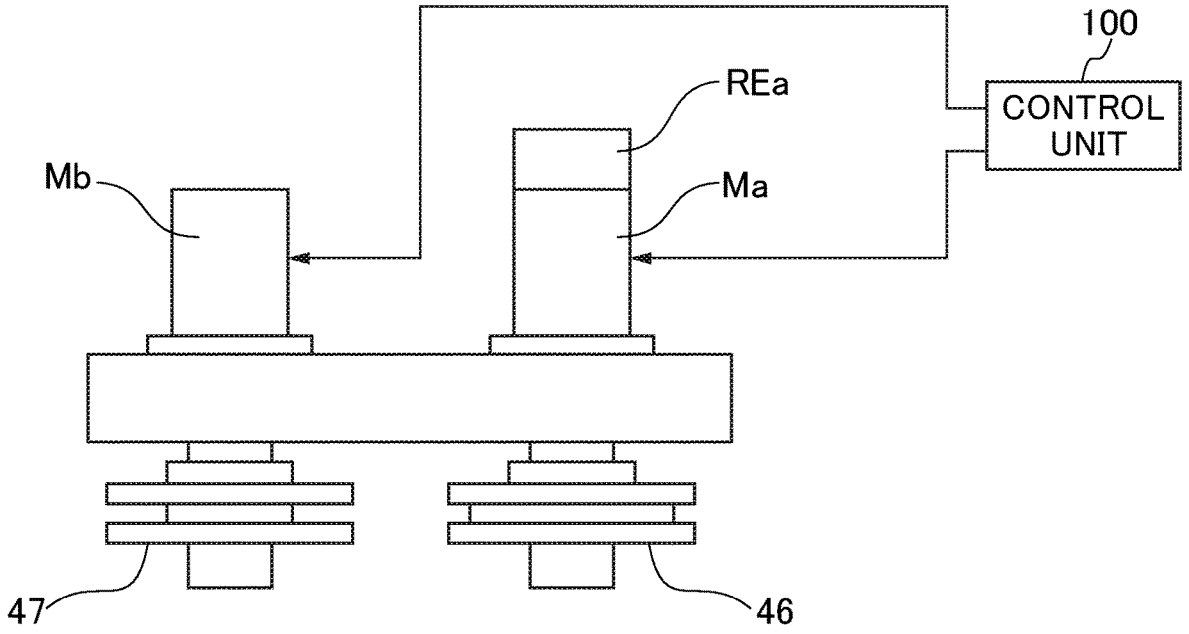
FIG. 5 is a diagram showing a configuration of the polishing tape supply/recovery mechanism of the polishing apparatus according to the present embodiment.

FIG. 5 is a diagram showing a configuration of the polishing tape supply/recovery mechanism of the polishing apparatus according to the present embodiment. As shown in FIG. 5, the tape supply reel 46 and the tape recovery reel 47 are respectively connected to a supply motor Ma and a recovery motor Mb for rotational driving. The supply motor Ma applies torque to the tape supply reel 46 and the recovery motor Mb applies torque to the tape recovery reel 47. In the present embodiment, the supply motor Ma is a servo motor and the recovery motor Mb is a torque motor. In addition, a rotary encoder REa for detecting a rotation angle is connected to the supply motor Ma. The supply motor Ma which gives torque to the tape supply reel 46 is controlled so that the tension of the tape is constant. In addition, the control unit 100 is connected to the supply motor Ma and the recovery motor Mb, and controls the supply motor Ma and the recovery motor Mb.

<Control Method According to Comparative Example>

In order to better understand the control method according to the present embodiment, a control method according to a comparative example will be described. In the comparative example, the torque of the supply motor Ma for rotating the tape supply reel 46 supplying the tape is controlled so that the tension of the tape is constant, and the tape is fed at a constant speed by the tape feed motor Mc. In addition, the control is performed such that the torque applied to the recovery motor Mb rotating the tape recovery reel 47 for recovering the tape is constant.

Figure 6:
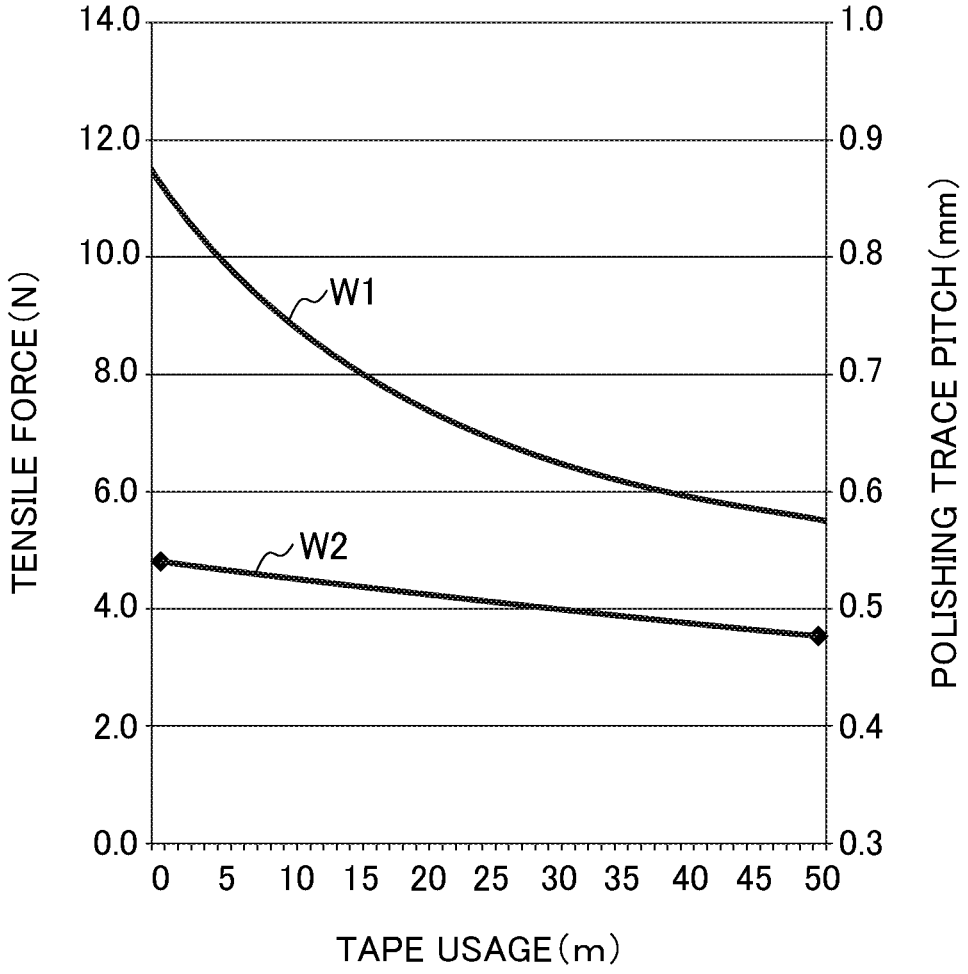
FIG. 6 is a graph showing a relationship between a tape usage and a calculation value of a tensile force of a tape and a relationship between the tape usage and an experimental value of a polishing trace pitch, in a case where a control method according to a comparative example is used.

FIG. 6 is a graph showing a relationship between a tape usage and a calculation value of a tensile force of a tape and a relationship between the tape usage and an experimental value of a polishing trace pitch, in a case where the control method according to the comparative example is used. In FIG. 6, a curve W1 is a graph showing the relationship between the tape usage and the calculation value of the tensile force of the tape. W2 is a graph showing the relationship between the tape usage and the experimental value of the polishing trace pitch.

As shown in FIG. 6, in the comparative example, the outer diameter of the tape roll recovered by the tape recovery reel 47 is changed and the tension applied to the polishing tape is changed, and thus, in actual, a feeding speed of the polishing tape is not constant, and the feeding speed of the polishing tape gradually slows down. Therefore, even if the tape feed motor Mc is rotated by a predetermined rotation speed, it is impossible to feed the polishing tape by an amount corresponding to the rotation speed, there is a problem that the polishing tape remains more than expected.

<Control Method According to Present Embodiment>

A control method according to the present embodiment solving the above-described problems will be described below.

First, the control unit 100 controls the torque applied to the supply motor Ma such that the tension applied to the polishing tape is constant depending on the outer diameter of the polishing tape wound around the tape supply reel 46. According to this configuration, the tension of the polishing tape when the polishing tape is discharged from the tape supply reel 46 can be constantly maintained.

In addition, using the feed length of the tape fed by the tape feed motor Mc and a thickness of the polishing tape, the control unit 100 controls the torque of the recovery motor Mb depending on the change in the outer diameter of the roll of the polishing tape wound by the tape recovery reel 47 such that the tension applied to the polishing tape is constant. According to this configuration, the control unit 100 can constantly maintain the tension applied to the polishing tape using the feed length of the tape fed by the tape feed motor controlled by the control unit 100 and the known thickness of the polishing tape. Therefore, it is not necessary to install an optical sensor, and it is possible to reduce a cost. In addition, since a feeding amount of the polishing tape fed by the tape feed motor is determined by control by the control unit, it is possible to grasp the feeding amount of the polishing tape even during polishing, and additional processing is not required between the polishing processing and a subsequent polishing processing. In this way, it is possible to constantly maintain the tension applied to the tape while reducing the cost and without requiring the additional processing between the polishing processing and the subsequent processing.

As an example of the control, the control unit 100 determines the outer diameter of the roll of the polishing tape recovered by the tape recovery reel 47 based on the feeding amount of the polishing tape fed by the tape feed motor Mc and the thickness of the polishing tape, and controls the torque of the recovery motor Mb depending on the outer diameter of the roll. According to this configuration, since the torque of the recovery motor Mb is controlled depending on the outer diameter of the roll of the polishing tape, it is possible to constantly maintain the tension applied to the polishing tape.

<Configuration of Control Unit>

Figure 7:
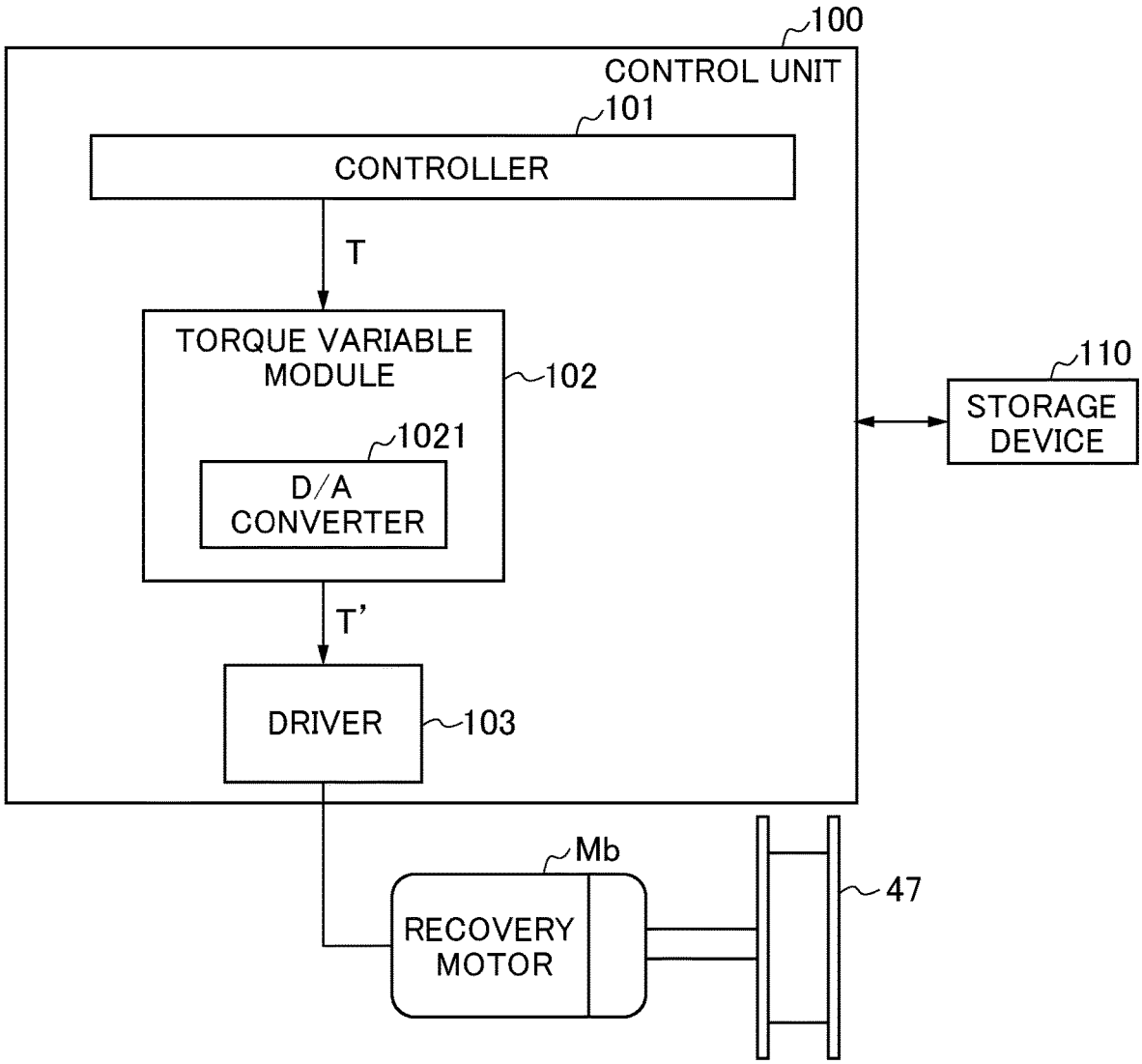
FIG. 7 is a block diagram showing a schematic configuration of a control unit.

Subsequently, a configuration of the control unit 100 for realizing the control method according to the present embodiment will be described below with reference to FIG. 7. FIG. 7 is a block diagram showing a schematic configuration of the control unit 100. As shown in FIG. 7, the control unit 100 is connected to the recovery motor Mb and controls the torque of the recovery motor Mb. The recovery motor Mb is a torque motor.

As shown in FIG. 7, the control unit 100 has a controller 101, a torque variable module 102, and a driver 103.

The controller 101 outputs a set torque command value T to the torque variable module 102.

The torque variable module 102 changes the set torque command value T input from the controller 101 and outputs a changed torque command value T' to the driver 103.

The driver 103 drives the recovery motor Mb such that the torque of the torque command value output from the torque variable module 102 is applied to the recovery motor Mb.

Figure 8:
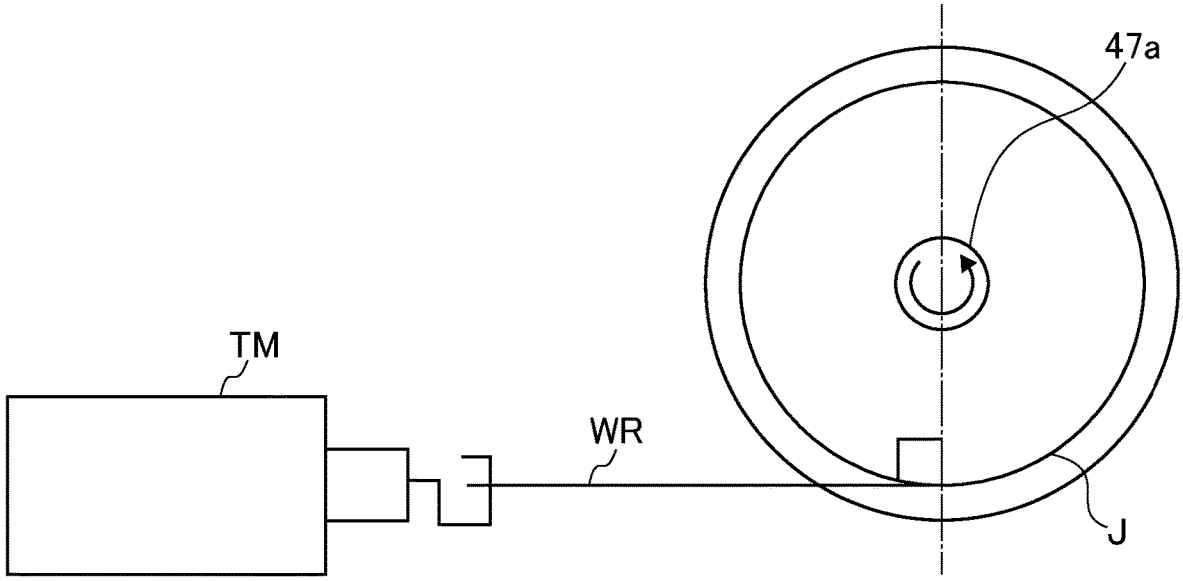
FIG. 8 is a schematic diagram for explaining a measurement of a set torque command value.

FIG. 8 is a schematic diagram for explaining a measurement of the set torque command value. In FIG. 8, a jig J is mounted on a core 47*a* of the tape recovery reel 47. An outer diameter of the jig is set such that a diameter of the roll of the polishing tape to be used is set to an outer diameter (maximum diameter) of a used roll. For example, in the case of a polishing tape of 100 m roll, the outer diameter of the polishing tape of 100 m roll is 70 mm, and thus, the outer diameter of the jig J is also set to 70 mm. One end of a polishing tape WR is fixed to an outer surface of the jig J, and the other end of the polishing tape WR is connected to a tension meter TM. In this state, the tension meter TM pulls the polishing tape at setting tension which is the tension constantly applied to the polishing tape. In this case, the torque command value output from the controller is acquired as the set torque command value.

By using the jig J in this manner, when the outer diameter of the roll of the polishing tape becomes the maximum diameter, the torque command value output from the controller 101 when the polishing tape is pulled by the setting tension which is the tension constantly applied to the polishing tape is acquired as the set torque command value. This set torque command value is stored in a storage device 110.

Figure 9:
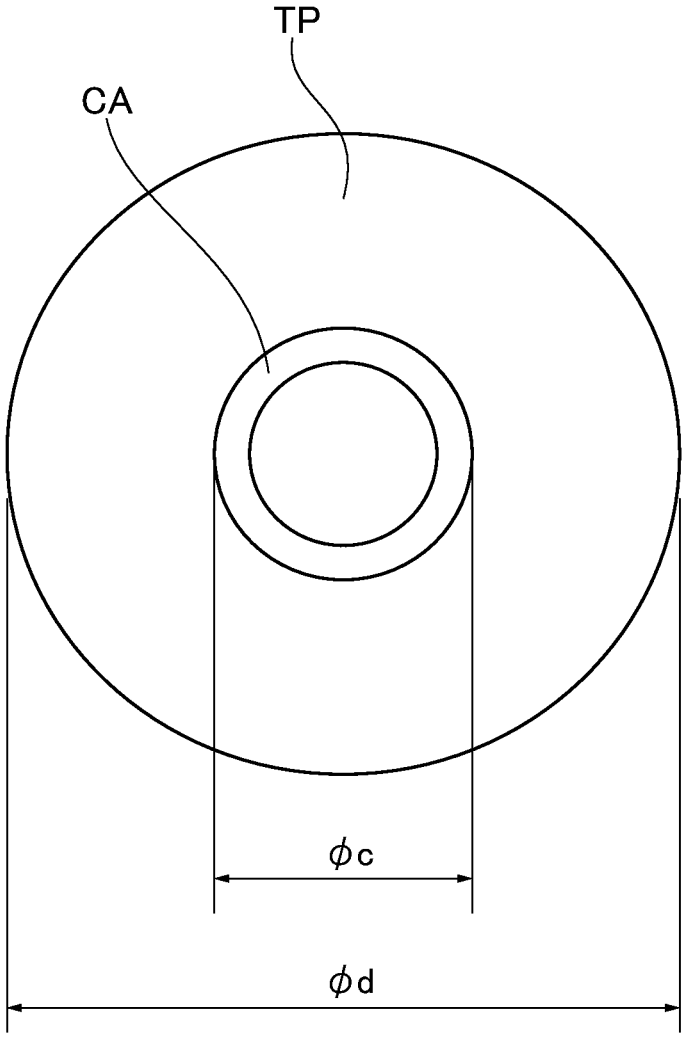
FIG. 9 is a sectional view showing an example of a roll of a polishing tape.

FIG. 9 is a sectional view showing an example of the roll of the polishing tape. As shown in FIG. 9, in a roll of a polishing tape, a polishing tape TP is wound around a core CA. In FIG. 9, an outer diameter c of the core CA and an outer diameter d of the roll of the polishing tape are shown.

Figure 10:
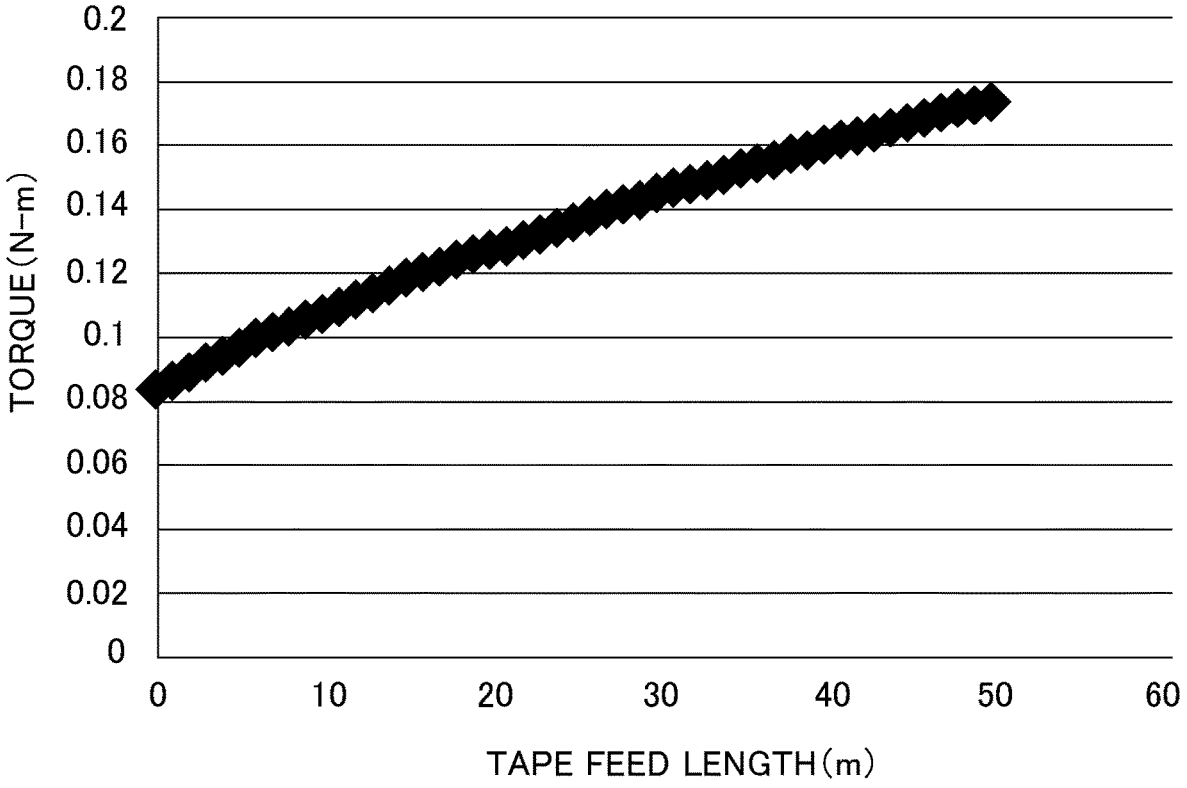
FIG. 10 is a graph showing a relationship between torque of a recovery motor and a tape feed length when tension related to the polishing tape is constantly maintained at 5.2 N.

FIG. 10 is a graph showing a relationship between the torque of a recovery motor Mb and the tape feed length when tension related to the polishing tape is constantly maintained at 5.2 N. As shown in FIG. 10, the outer diameter of the roll of the polishing tape wound by the tape recovery reel 47 increases as the tape feed length increases. Under constant tension, the torque is proportional to the outer diameter of the roll of the polishing tape.

<Flow of Control Method According to Present Embodiment>

Figure 11:
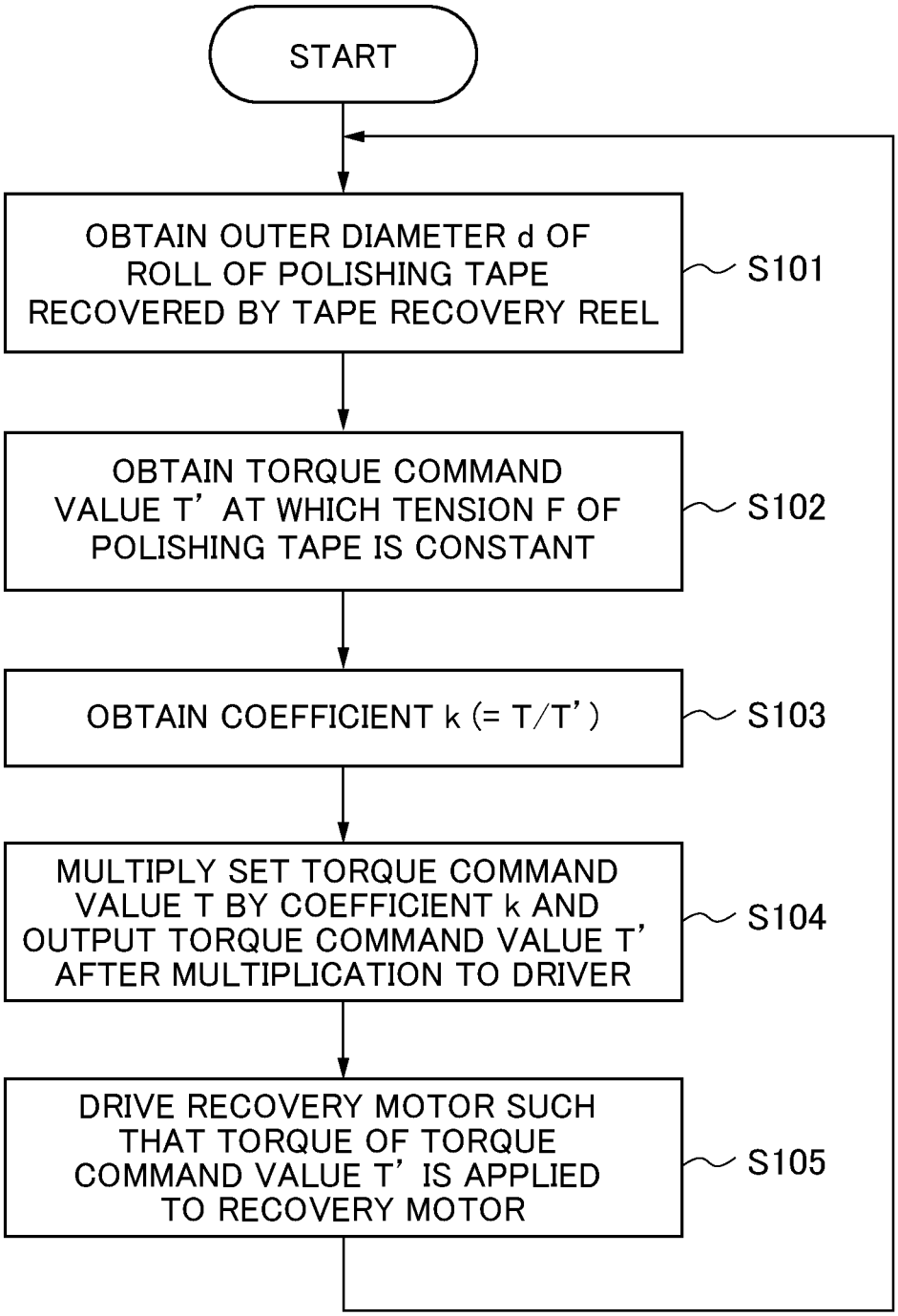
FIG. 11 is a flowchart showing an example of a flow of a control method according to the present embodiment.

Hereinafter, a flow of the control method according to the present embodiment will be described with reference to a flowchart of FIG. 11. FIG. 11 is a flowchart showing an example of the flow of the control method according to the present embodiment. In FIG. 11, the set torque command value T is stored in the storage device 110 in advance.

(Step S101)

First, the torque variable module 102 of the control unit 100 determines the outer diameter d of the roll of the polishing tape recovered by the tape recovery reel 47 according to the following Expression.

$$L \times t = \eta/4 \times (d^2 - c^2) \quad (1)$$

Here, L is the tape feed length and t is a known tape thickness. A right side of the Expression represents the cross sectional area of the roll of the polishing tape in FIG. 9, and this cross sectional area is equal to a value which is obtained by multiplying the tape feed length L by the known tape thickness t as shown in a left side of the Expression. Here, the tape feed length L is calculated by the torque variable module 102 of the control unit 100 by multiplying a counter value of a stepping motor instructed by the control unit 100 by a preset rotation angle per unit count.

(Step S102)

Next, the torque variable module 102 of the control unit 100 determines torque T' at which the tension F of the polishing tape is constant, according to the following Expression.

$$T' = (d/2) \times F \quad (2)$$

(Step S103)

Next, the torque variable module 102 of the control unit 100 determines a coefficient k (=T'/T). In this case, the set torque command value T is read from the storage device 110 by the control unit 100.

(Step S104)

Next, the torque variable module 102 of the control unit 100 multiplies the set torque command value T by the coefficient k and outputs the torque command value T' obtained by the multiplication to the driver 103. In this case, the torque variable module 102 converts the torque command value T' from a digital signal into an analog signal and outputs the converted signal to the driver 103.

(Step S105)

Next, the driver 103 of the control unit 100 controls the recovery motor Mb such that the torque of the torque command value T' is applied to the recovery motor Mb. Accordingly, the tension applied to the polishing tape can be the constant tension F. Thereafter, the processing is returned to Step S101. In this way, the control unit 100 performs the processing of the above-described Steps S101 to S105 at predetermined time intervals.

As described above, the torque variable module 102 according to the present embodiment determines the torque T' at which the tension of the polishing tape is constant depending on the determined outer diameter (diameter) of the roll of the polishing tape, determines the coefficient k obtained by dividing the determined torque T' by the set torque command value T, multiplies the set torque command value T by the coefficient k, and outputs the torque command value T' after the multiplication. Here, the torque variable module 102 has a D/A converter 1021. When the D/A converter 1021 outputs the torque command value, the D/A converter 1021 converts the torque command value from a digital signal to an analog signal and outputs the converted signal. According to this configuration, in the case where the recovery motor is a torque motor, it is possible to constantly maintain the tension applied to the polishing tape. Since the torque motor is cheaper than the servo motor, a cost can be reduced.

The torque variable module 102 determines the torque T' at which the tension of the polishing tape is constant depending on the outer diameter of the roll of the polishing tape. However, the present technique is not limited to this, and the torque T' at which the tension of the polishing tape is constant may be determined depending on not the outer diameter of the roll of the polishing tape but a radius thereof.

Figure 12:
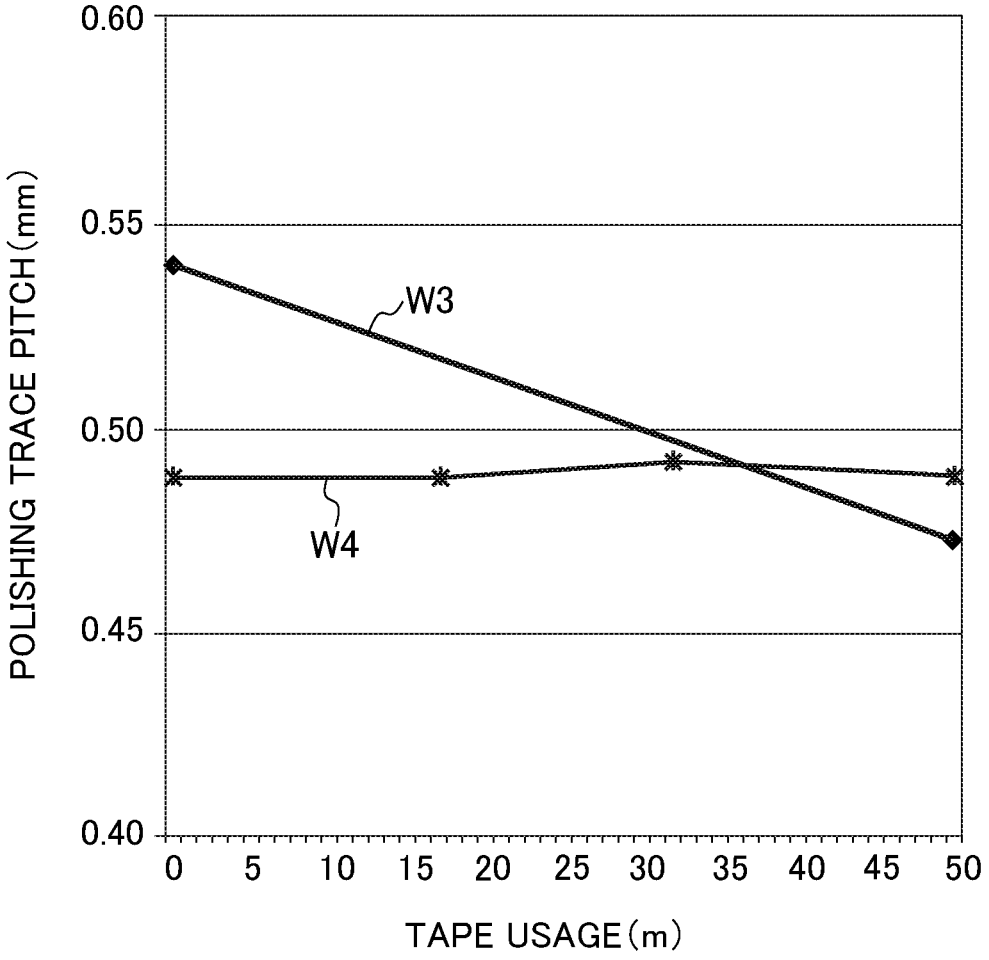
FIG. 12 is a graph comparing a relationship between the tape usage and the polishing trace pitch in the comparative example and a relationship between the tape usage and the polishing trace pitch in the present embodiment with each other.

FIG. 12 is a graph comparing a relationship between the tape usage and the polishing trace pitch in the comparative example and a relationship between the tape usage and the polishing trace pitch in the present embodiment with each other. A curve W3 is a graph showing the relationship between the tape usage and a measured value of the polishing trace pitch in the comparative example. A curve W4 is a graph showing the relationship between the tape usage and the measured value of the polishing trace pitch in the present embodiment. In the comparative example, as shown by the curve W3, the torque applied to the recovery motor Mb is controlled to be constant, the polishing trace pitch is narrowed as the tape usage increases. Meanwhile, in the present embodiment, as shown by the curve W4, the tension applied the polishing tape is controlled to be constant, and thus, the polishing trace pitch is constant even if the tape usage increases.

Effect of Present Embodiment

According to the substrate processing apparatus 10 according to the present embodiment, the tension applied to the polishing tape can always be the constant tension F from start the winding of the polishing tape to end of winding of the polishing tape by the tape recovery reel 47. As a result, the tape recovery reel 47 can recover the polishing tape at a constant speed from the start of the winding of the polishing tape to the end of the winding thereof, and can use the polishing tape without waste.

Moreover, the control unit 100 may determine a replacement timing of the polishing tape using the feed length of the tape fed by the tape feed motor Mc. Accordingly, it is possible to replace the polishing tape at any timing just before the tape feed length is the same as the length of the roll of the polishing tape.

First Modification Example

The control of the torque of the recovery motor according to the present embodiment may be applied to the control of the torque of the supply motor. Specifically, the control unit 100 may control the torque of the supply motor Ma depending on the change in the outer diameter of the roller of the polishing tape in the tape supply reel 46 such that the tension applied to the polishing tape is constant, using the feed length of the tape fed by the tape feed motor Mc and the thickness of the polishing tape. That is, an area of a side surface of the roll of the polishing tape in the tape supply reel 46 at a start of the tape feeding is obtained, a product of the tape feed length and the thickness of the polishing tape at a certain time is subtracted from the area at the start of the tape feeding so as to calculate an area of the side surface of the roll of the polishing tape in the tape supply reel 46 at the time, and thus, the radius of the roll of the polishing tape in the tape supply reel 46 at the time can be obtained. Therefore, according to the same manner similar to that of the recovery motor, it is possible to control the torque of the supply motor such that the tension of the tape is constant.

According to this configuration, the control unit 100 can constantly maintain the tension applied to the polishing tape using the feeding amount of the polishing tape fed by the tape feed motor controlled by the control unit 100 and the known thickness of the polishing tape. Therefore, it is not necessary to install an optical sensor, and it is possible to reduce a cost. In addition, since the feeding amount of the polishing tape fed by the tape feed motor is determined by control by the control unit, it is possible to grasp the feeding amount of the polishing tape even during polishing, and additional processing is not required between the polishing processing and a subsequent polishing processing. In this way, it is possible to constantly maintain the tension applied to the tape while reducing the cost and without requiring the additional processing between the polishing processing and the subsequent polishing processing.

In this case, the supply motor may be changed from the servo motor to the torque motor. As a result, the cost of the supply motor can be reduced.

In the present embodiment and the first modification example, the control of the notch polishing section 40 is described. However, the control of the bevel polishing section 50 may be performed similarly to the control of the notch polishing section 40. In addition, the present technique is applied to the polishing tape. However, the present technique may be applied to substrate processing which uses a processing tape such as a cleaning tape.

As described above, the present technique is not limited to the above-described embodiment as it is, and structural elements can be modified and embodied at an implementation stage without departing from the gist thereof. In addition, various inventions can be formed by appropriately combining a plurality of constituent elements disclosed in the above-described embodiment. For example, some constituent elements may be deleted from all the constituent elements shown in the embodiment. Moreover, the constituent elements of different embodiments may be appropriately combined.

REFERENCE SIGNS LIST

10: substrate processing apparatus
100: control unit
101: controller
102: torque variable module
1021: D/A converter
103: driver
11: housing
110: storage device
12: opening part
13: shutter
14: partition plate
15: upper chamber
16: lower chamber
17: opening part
20: substrate holding stage unit

21: unit main body
22: support
23: substrate holding stage
24: pad
26*b*: groove
27: shaft
28: pipe
29: shaft base
30: pulley
31: belt
33: motor
40: notch polishing section
43: polishing tape
44: polishing head
46: tape supply reel
47: tape recovery reel
47*a*: core
50: bevel polishing section
54: polishing head
55: polishing tape supply/recovery mechanism
56: tape supply reel
57: tape recovery reel
58: nozzle
60: substrate holding stage movement means
61: shaft
62: support plate
63: movable plate
63*a*: opening part
64: linear guide
65: linear guide
67: pulley
68: belt
69: motor
70: ball screw
71: motor
72: ball screw
73: motor
80: substrate chuck mechanism

What is claimed is:

1. A substrate processing apparatus which causes a processing tape to abut against a processing object and processes the processing object by a relative movement of the processing tape and the processing object, comprising:

a tape supply reel configured to supply the processing tape;

a tape recovery reel configured to recover the processing tape;

a recovery motor configured to apply a torque to the tape recovery reel;

a tape feed motor configured to feed the processing tape between the tape supply reel and the tape recovery reel; and a control unit configured to control the tape feed motor, wherein the control unit controls the torque of the recovery motor depending on a change in an outer diameter of a roll of the processing tape wound by the tape recovery reel such that tension applied to the processing tape is constant, wherein the control unit determines the outer diameter of the roll of the processing tape recovered by the tape recovery reel based on the feed length of the tape fed by the tape feed motor and the thickness of the processing tape, and controls the torque of the recovery motor depending on the outer diameter of the roll on the recovery reel.

2. The substrate processing apparatus according to claim 1, wherein the recovery motor is a torque motor, when the outer diameter of the roll of the processing tape is a maximum diameter, a torque command value output from a controller when the processing tape is pulled by setting tension, which is the tension constantly applied to the processing tape, is stored in a storage device as a set torque command value, and the control unit has a controller which outputs the set torque command value, a torque variable module which determines a torque at which the tension of the processing tape is constant depending on the determined diameter or radius of the roll of the processing tape, determines a coefficient obtained by dividing the determined torque by the set torque command value, multiplies the torque command value by the coefficient, and outputs the torque command value after the multiplication, and a driver which drives the recovery motor such that a torque of the torque command value output from the torque variable module is applied to the recovery motor.

3. The substrate processing apparatus according to claim 2, wherein the torque variable module has a D/A converter, and the D/A converter converts the torque command value from a digital signal into an analog signal when the torque command value is output, and outputs the converted signal.

4. The substrate processing apparatus according to claim 1, wherein the tape feed motor is a servo motor, and the control unit determines a feed length of the tape fed by the tape feed motor, based on the number of rotations of the servo motor from a feeding start of the processing tape to a current time and a preset tape feed length per revolution.

5. The substrate processing apparatus according to claim 1, wherein the control unit determines a replacement timing of the processing tape using the feed length of the tape fed by the tape feed motor.

6. The substrate processing apparatus according to claim 1, further comprising a supply motor configured to apply a torque to the tape supply reel, wherein the supply motor is a servo motor, and the control unit controls the torque applied to the supply motor such that tension applied to the processing tape is constant depending on the outer diameter of the processing tape wound around the tape supply reel.

7. A substrate processing apparatus which causes a processing tape to abut against a processing object and processes the processing object by a relative movement of the processing tape and the processing object, comprising:

a tape supply reel configured to supply the processing tape;

a supply motor configured to apply a torque to the tape supply reel;

a tape recovery reel configured to recover the processing tape;

a tape feed motor configured to feed the processing tape between the tape supply reel and the tape recovery reel; and a control unit configured to control the tape feed motor, wherein the control unit controls the torque of the supply motor depending on a change in an outer diameter of a roll of the processing tape in the tape supply reel such that tension applied to the processing tape is constant, wherein the control unit determines the outer diameter of the roll of the processing tape of the tape supply reel based on the feed length of the tape fed by the tape feed motor and the thickness of the processing tape, and controls the torque of the supply motor depending on the outer diameter of the roll on the supply reel.

8. A control method performed by a substrate processing apparatus which includes a tape supply reel configured to supply a processing tape, a tape recovery reel configured to recover the processing tape, a recovery motor configured to apply a torque to the tape recovery reel, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising:

controlling, by the control unit, the torque of the recovery motor depending on a change in an outer diameter of a roll of the processing tape wound by the tape recovery reel such that tension applied to the processing tape is constant, wherein the control unit determines the outer diameter of the roll of the processing tape recovered by the tape recovery reel based on the feed length of the tape fed by the tape feed motor and the thickness of the processing tape, and controls the torque of the recovery motor depending on the outer diameter of the roll on the recovery reel.

9. A control method performed by a substrate processing apparatus which includes a tape supply reel configured to supply a processing tape, a supply motor configured to apply a torque to the tape supply reel, a tape recovery reel configured to recover the processing tape, a tape feed motor configured to feed the processing tape between the tape supply reel and the tape recovery reel, and a control unit configured to control the tape feed motor, and causes the processing tape to abut against a processing object and processes the processing object by a relative movement of the processing tape and the processing object, the control method comprising:

controlling, by the control unit, the torque of the supply motor depending on a change in an outer diameter of a roll of the processing tape in the tape supply reel such that tension applied to the processing tape is constant, wherein the control unit determines the outer diameter of the roll of the processing tape of the tape supply reel based on the feed length of the tape fed by the tape feed motor and the thickness of the processing tape, and controls the torque of the supply motor depending on the outer diameter of the roll on the supply reel.

* * * * *